US010273137B2

(12) United States Patent
Garrison et al.

(10) Patent No.: US 10,273,137 B2
(45) Date of Patent: Apr. 30, 2019

(54) FUEL DISPENSING NOZZLE WITH INTERLOCK

(71) Applicants: Timothy M. Garrison, Cincinnati, OH (US); John M. Gray, Cincinnati, OH (US); Brenton T. Hershner, West Chester, OH (US)

(72) Inventors: Timothy M. Garrison, Cincinnati, OH (US); John M. Gray, Cincinnati, OH (US); Brenton T. Hershner, West Chester, OH (US)

(73) Assignee: OPW FUELING COMPONENTS, LLC, Hamilton, OH (US)

( * ) Notice: Subject to any disclaimer, the term of this patent is extended or adjusted under 35 U.S.C. 154(b) by 231 days.

(21) Appl. No.: 15/224,017

(22) Filed: Jul. 29, 2016

(65) Prior Publication Data

US 2018/0029872 A1 Feb. 1, 2018

(51) Int. Cl.

| | |
|---|---|
| ***B67D 7/34*** | (2010.01) |
| ***B67D 7/00*** | (2010.01) |
| ***B67D 7/04*** | (2010.01) |
| ***B67D 7/48*** | (2010.01) |
| ***B67D 7/54*** | (2010.01) |

(52) U.S. Cl.

CPC ..... *B67D 7/344* (2013.01); *B67D 7/005* (2013.01); *B67D 7/04* (2013.01); *B67D 7/48* (2013.01); *B67D 7/54* (2013.01); *B67D 2007/545* (2013.01)

(58) Field of Classification Search

CPC ..... B67D 7/344; B67D 7/005; B67D 7/04; B67D 7/48

USPC ..... 141/59, 206

See application file for complete search history.

(56) References Cited

U.S. PATENT DOCUMENTS

| | | | | |
|---|---|---|---|---|
| 2,547,690 A | | 4/1951 | Chadil et al. | |
| 2,582,195 A | | 1/1952 | Duerr | |
| 3,085,600 A | | 4/1963 | Briede | |
| 3,653,415 A | | 4/1972 | Boudot et al. | |
| 3,982,571 A | * | 9/1976 | Fenton | B67D 7/54 141/225 |
| 4,023,601 A | | 5/1977 | Hansel | |
| 4,033,389 A | | 7/1977 | Hansel et al. | |
| 4,058,149 A | | 11/1977 | Hansel | |
| 4,059,135 A | | 11/1977 | Hansel | |
| 4,103,936 A | | 8/1978 | Sutcliffe et al. | |
| 4,121,635 A | | 10/1978 | Hansel | |
| 4,354,536 A | | 10/1982 | Moss | |

(Continued)

FOREIGN PATENT DOCUMENTS

WO 2006/113296 10/2006

*Primary Examiner* — Timothy L Maust

(74) *Attorney, Agent, or Firm* — Thompson Hine LLP

(57) ABSTRACT

A nozzle for dispensing fluid including a nozzle body having a spout and fluid path through which fluid to be dispensed is flowable. The nozzle includes an actuator configured to detect when the spout is sufficiently inserted into a fluid receptacle, and a shut-off device configured to selectively terminate or prevent fluid dispensing operations through the fluid path. The nozzle further includes an interlock operatively coupling the actuator to the shut-off device. The interlock includes a slider that is operatively coupled to the actuator and a pivotable arm that is operatively coupled to the shut-off device, and the slider is slidable along the arm.

31 Claims, 17 Drawing Sheets

(56) References Cited

U.S. PATENT DOCUMENTS

| | | | | | |
|---|---|---|---|---|---|
| 4,418,730 | A * | 12/1983 | McMath | B67D 7/48 141/207 |
| 4,453,578 | A | 6/1984 | Wilder | |
| 4,557,302 | A | 12/1985 | Sunderhaus | |
| 4,825,914 | A | 5/1989 | Leininger | |
| 4,971,121 | A | 11/1990 | Guertin | |
| 5,069,260 | A | 12/1991 | Shea | |
| 5,085,258 | A | 2/1992 | Fink, Jr. et al. | |
| 5,121,777 | A * | 6/1992 | Leininger | B67D 7/42 141/207 |
| 5,127,451 | A | 7/1992 | Fink, Jr. et al. | |
| 5,655,576 | A | 8/1997 | Leininger et al. | |
| 6,851,628 | B1 | 2/2005 | Garrison et al. | |
| 6,951,229 | B2 | 10/2005 | Garrison et al. | |
| 7,000,657 | B1 | 2/2006 | Thorpe et al. | |
| 7,082,972 | B1 | 8/2006 | Healy | |
| 7,134,580 | B2 | 11/2006 | Garrison et al. | |
| 7,406,988 | B2 * | 8/2008 | Mitchell | B67D 7/54 141/206 |
| 7,575,028 | B2 | 8/2009 | Thorpe et al. | |
| 2014/0096868 | A1 | 4/2014 | Garrison et al. | |

* cited by examiner

FUEL DISPENSING NOZZLE WITH INTERLOCK

The present invention is directed to a fuel dispensing nozzle, and more particularly, to a fuel dispensing nozzle with an interlock which links dispensing operations to sufficient insertion of the nozzle.

BACKGROUND

Fuel dispensers are widely utilized to dispense fluid or fuels, such as gasoline, diesel, natural gas, biofuels, blended fuels, propane, oil, ethanol or the like, into the fuel tank of a vehicle or other receptacle. Such dispensers typically include a nozzle that is insertable into the fuel tank or receptacle. In some cases the nozzle may include an interlock that is configured to prevent the nozzle from dispensing fluid unless the nozzle is sufficiently inserted into the fuel tank or receptacle. However, existing interlock devices may not be sufficiently robust or repeatable.

SUMMARY

In one embodiment, the invention is a nozzle for dispensing fluid including a nozzle body having a spout and fluid path through which fluid to be dispensed is flowable. The nozzle includes an actuator configured to detect when the spout is sufficiently inserted into a fluid receptacle, and a shut-off device configured to selectively terminate or prevent fluid dispensing operations through the fluid path. The nozzle further includes an interlock operatively coupling the actuator to the shut-off device. The interlock includes a slider that is operatively coupled to the actuator and a pivotable arm that is operatively coupled to the shut-off device, and the slider is slidable along the arm.

DETAILED DESCRIPTION

System Overview

Figure 1:
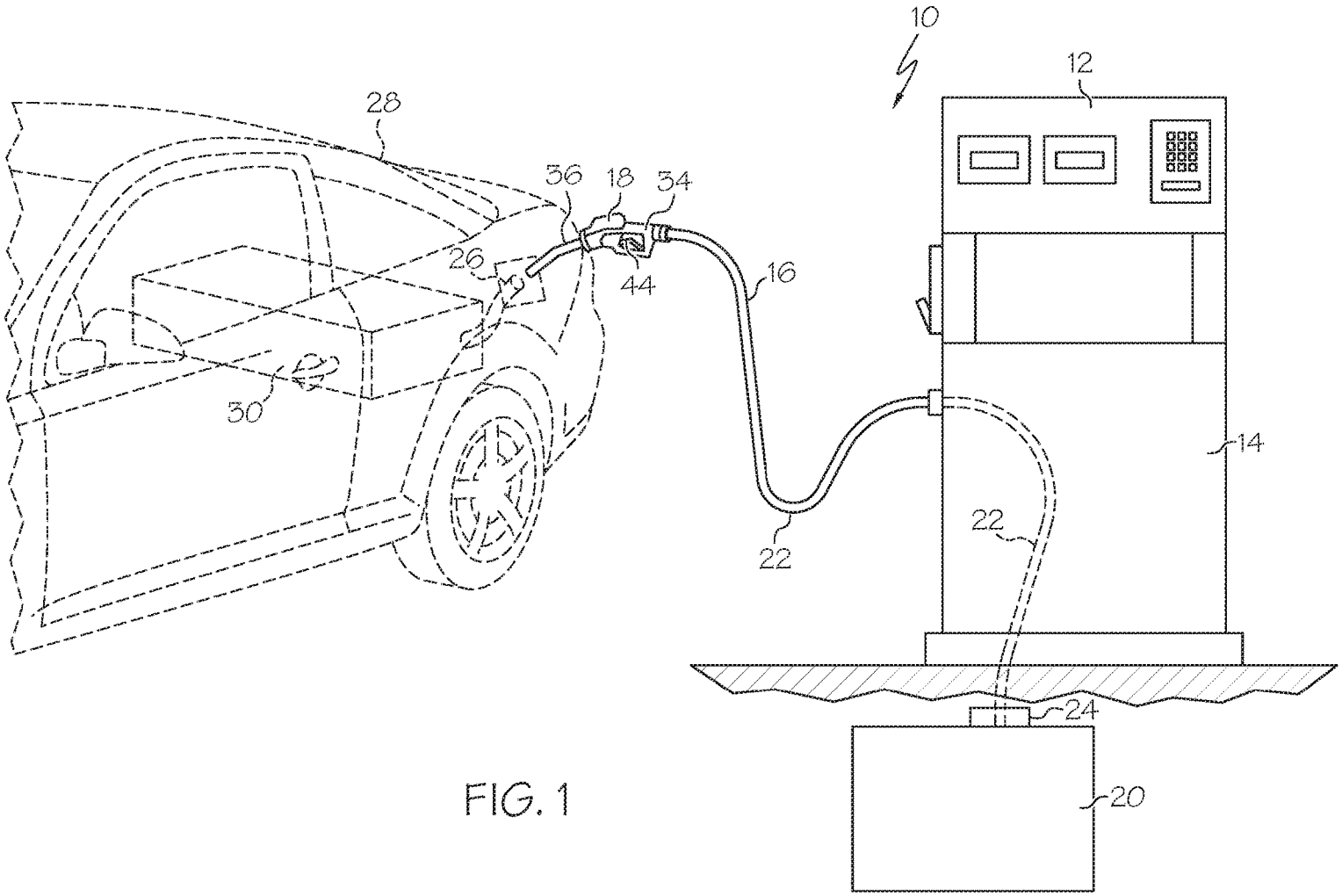
FIG. 1 is a schematic representation of a refilling system, with the nozzle positioned to be inserted into a vehicle fill pipe.

FIG. 1 is a schematic representation of a refilling system 10 including a dispenser 12. The dispenser 12 includes a dispenser body 14, a hose 16 coupled to the dispenser body 14, and a nozzle 18 positioned at the distal end of the hose 16. The hose 16 may be generally flexible and pliable to allow the hose 16 and nozzle 18 to be positioned in a convenient refilling position as desired by the user/operator.

The dispenser 12 is in fluid communication with a fuel/fluid storage tank 20 via a liquid or fluid conduit or fluid path 22 that extends from the dispenser 12 to the storage tank 20. The storage tank 20 can include or be fluidly coupled to a pump 24 which is configured to draw fluid/fuel out of the storage tank 20 and supply the fluid to the dispenser 12/nozzle 18. The nozzle 18 can be inserted into a fill pipe 26 of a vehicle 28 and operated to fill/refuel a fuel tank/fluid receptacle 30 of the vehicle 28, or to fill some other fuel/fluid containment vessel.

The nozzle 18/dispenser 12 can also be configured to capture and route vapors being expelled from the storage tank 30 during refueling via a vapor recovery system (not shown). In this case the nozzle 18 and hose 16 can each include a vapor recovery path (not shown) that is fluidly isolated from the fluid path 22. The system 10 and nozzle 18 can be utilized to store/dispense any of a wide variety of fluids, liquids or fuels or fuel additives, including but not limited to petroleum-based fuels or fluids, such as gasoline, diesel, natural gas, biofuels, blended fuels, propane, oil, ethanol, diesel exhaust fluid ("DEF"), and the like.

Figure 4:
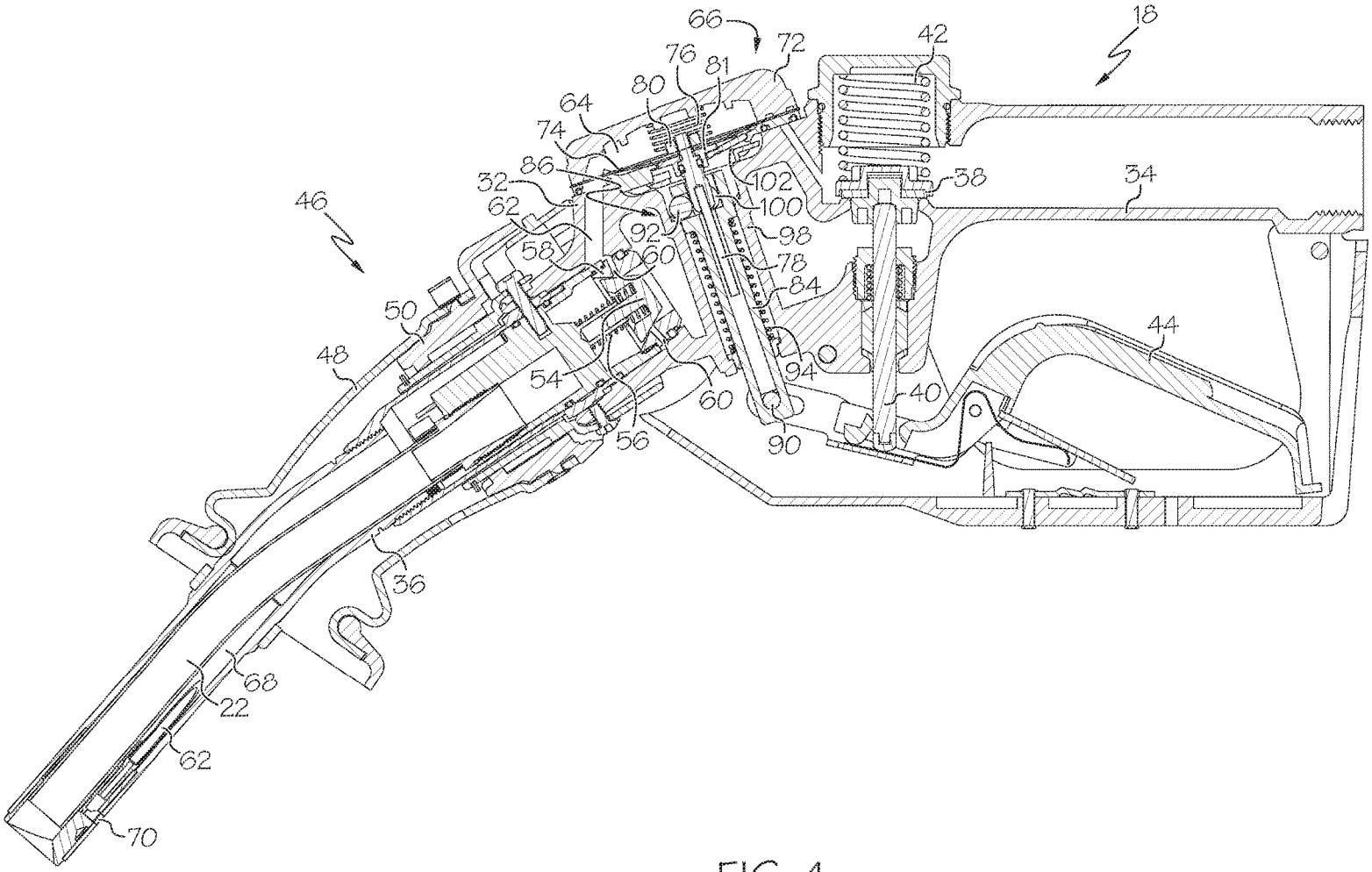
FIG. 4 illustrates the nozzle of FIG. 2 with the actuator/interlock engaged.
Figure 5:
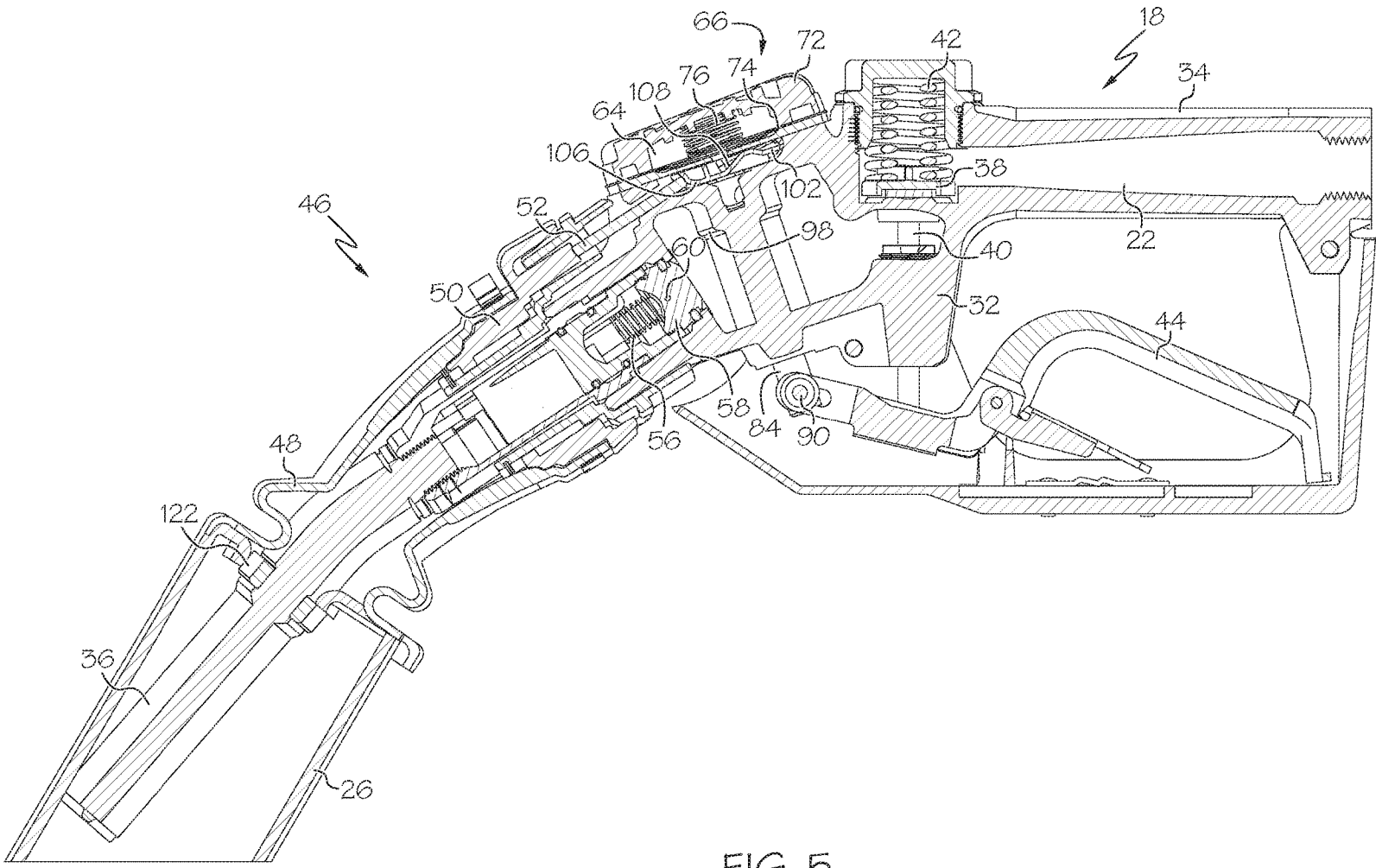
FIG. 5 is an offset cross section of the nozzle of FIG. 3, shown in conjunction with a fill pipe engaged by the actuator.
Figure 6:
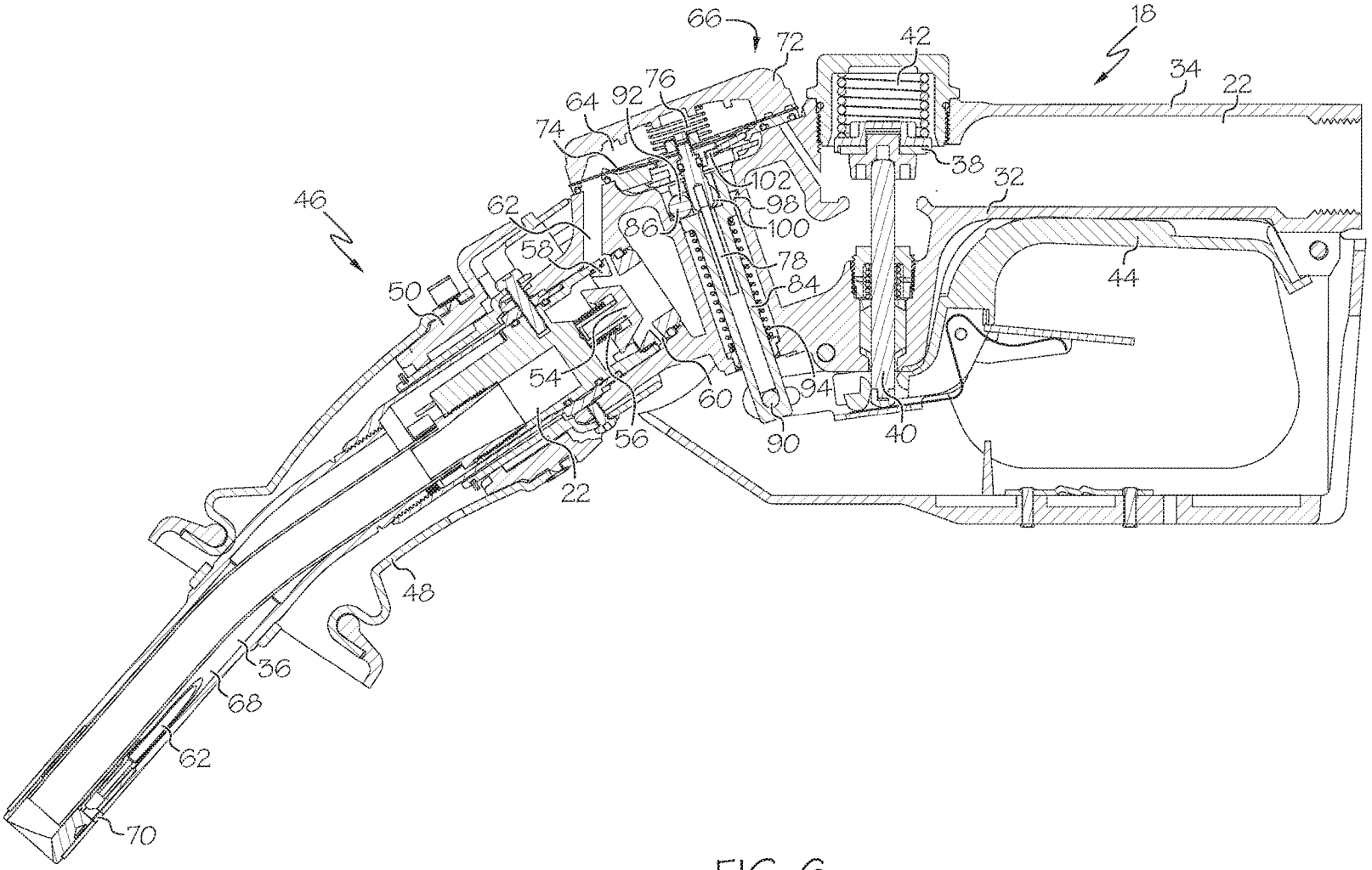
FIG. 6 illustrates the nozzle of FIG. 4 with the lever raised and fluid valve opened.

With reference to FIGS. 2-8, the nozzle 18 may include a nozzle body 32 having a generally cylindrical inlet 34 leading directly to or forming part of the fluid path 22 of the nozzle 18, and a spout 36 coupled to the nozzle body 32. The inlet 34 is configured to be fluidly connected to an associated hose 16, such as by threaded attachment. The nozzle 18 can include a fluid valve 38 positioned in the fluid path 22 to control the flow of fluid to be dispensed therethrough. The fluid valve 38 is carried on, or operatively coupled to, a fluid valve stem 40, and is biased to its closed position by a fluid valve spring 42. The bottom of the fluid valve stem 40 is positioned on or operatively coupled to a handle/lever 44 which can be manually raised or actuated by the user. In order to operate the nozzle 18 and dispense fluid, the user can manually raise the lever 44, and when refilling conditions are appropriate (as will be described in greater detail below), the lever 44 engages and raises the fluid valve stem 40, thereby opening the fluid valve 38, as shown in FIG. 6. When the fluid valve 38 is open, fluid can flow through the fluid path 22 of the nozzle 18, and flow through the spout 36, exiting a distal end thereof.

Actuator

An actuator 46 is positioned adjacent to the spout 36 and extends entirely or partially circumferentially thereabout. The actuator 46 can include a set of bellows or an engagement body 48 extending generally circumferentially about said spout 36, and a relatively rigid actuator guide 50 rigidly coupled to a base end of the bellows/engagement body 48. The engagement body 48 can in one case have an accordion style shape which is somewhat compressible to enable the engagement body 48 to fit up against and adapt to vehicles 28 and fill pipes 26 having differing configurations. The engagement body 48 is coupled to the actuator guide 50 which is in turn coupled to a pair of oppositely positioned pushrods 52 (see FIGS. 3, 5 and 9). The pushrods 52 are symmetrically positioned with respect to a longitudinal axis of the nozzle 18. The symmetrical arrangement of the pushrods 52 help to provide even loading, as will be described in greater detail below, and the use of two pushrods 52 also helps to provide a level of redundancy so that the actuator 46 may be able to continue to operate if one of the pushrods 52 should fail.

Figure 3:
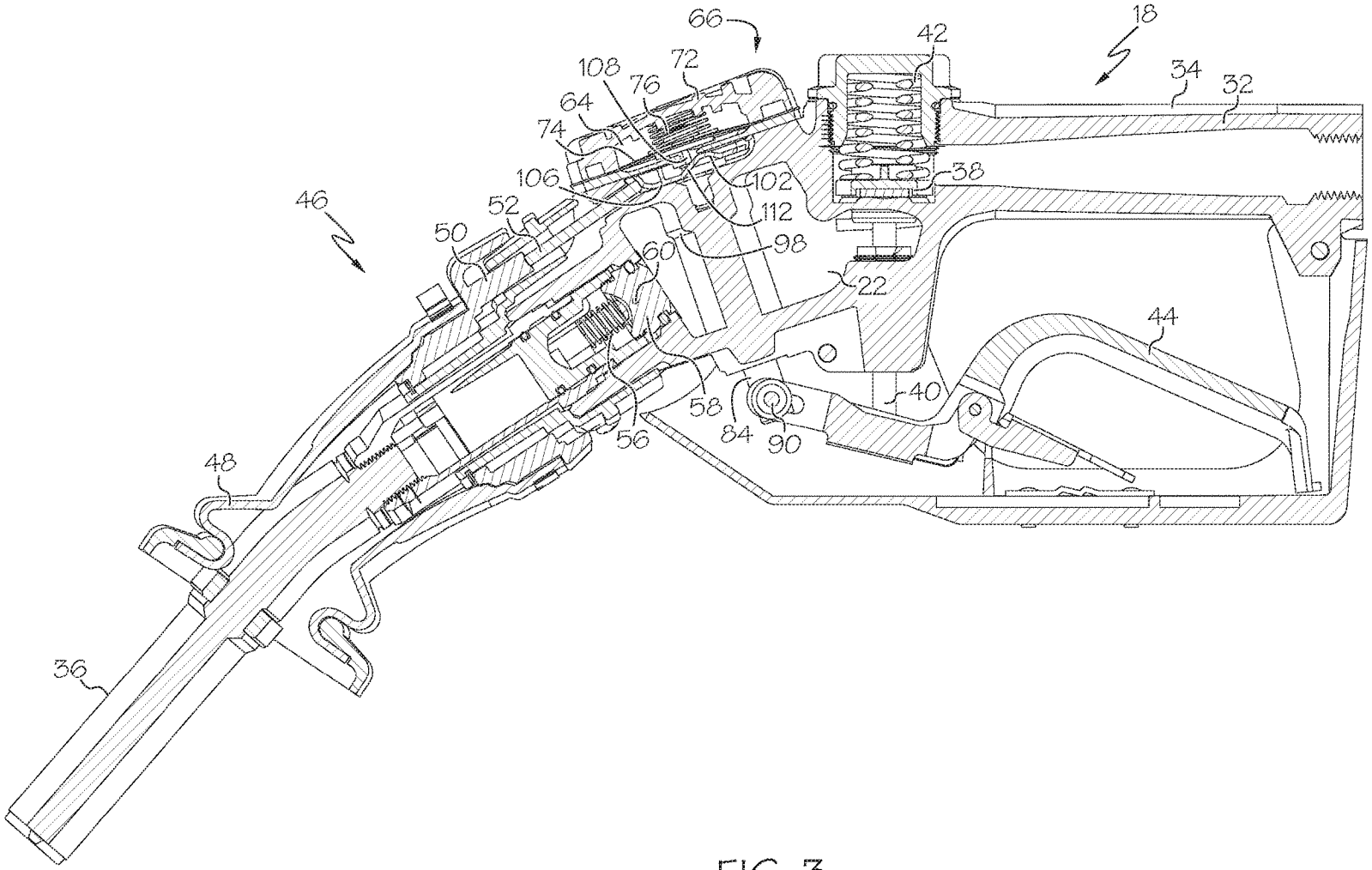
FIG. 3 is an offset cross section of the nozzle of FIG. 2.
Figure 9:
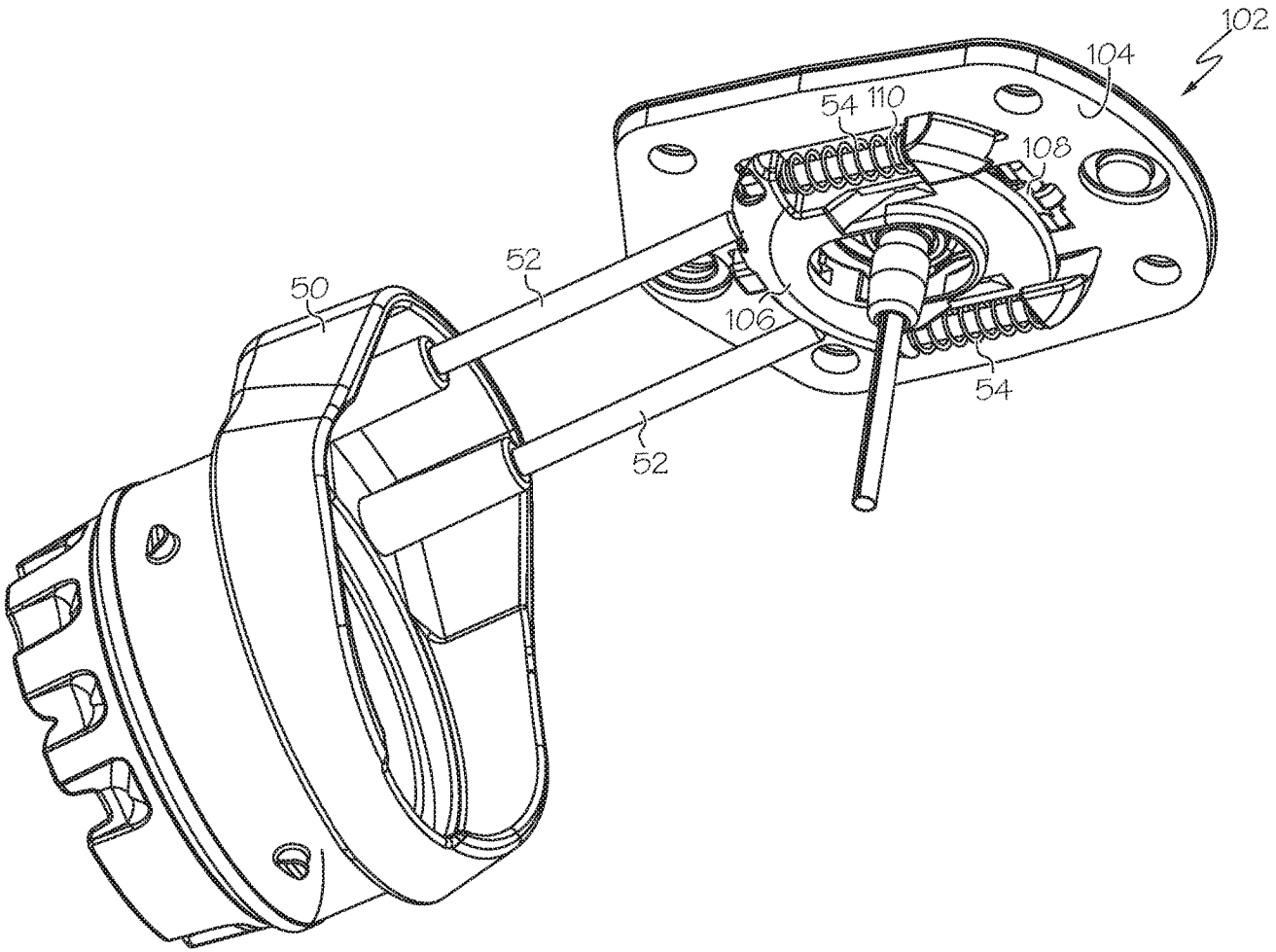
FIG. 9 is a lower perspective view illustrating the actuator guide coupled to the interlock by a pair of pushrods, with the pushrods in their extended positions.
Figure 10:
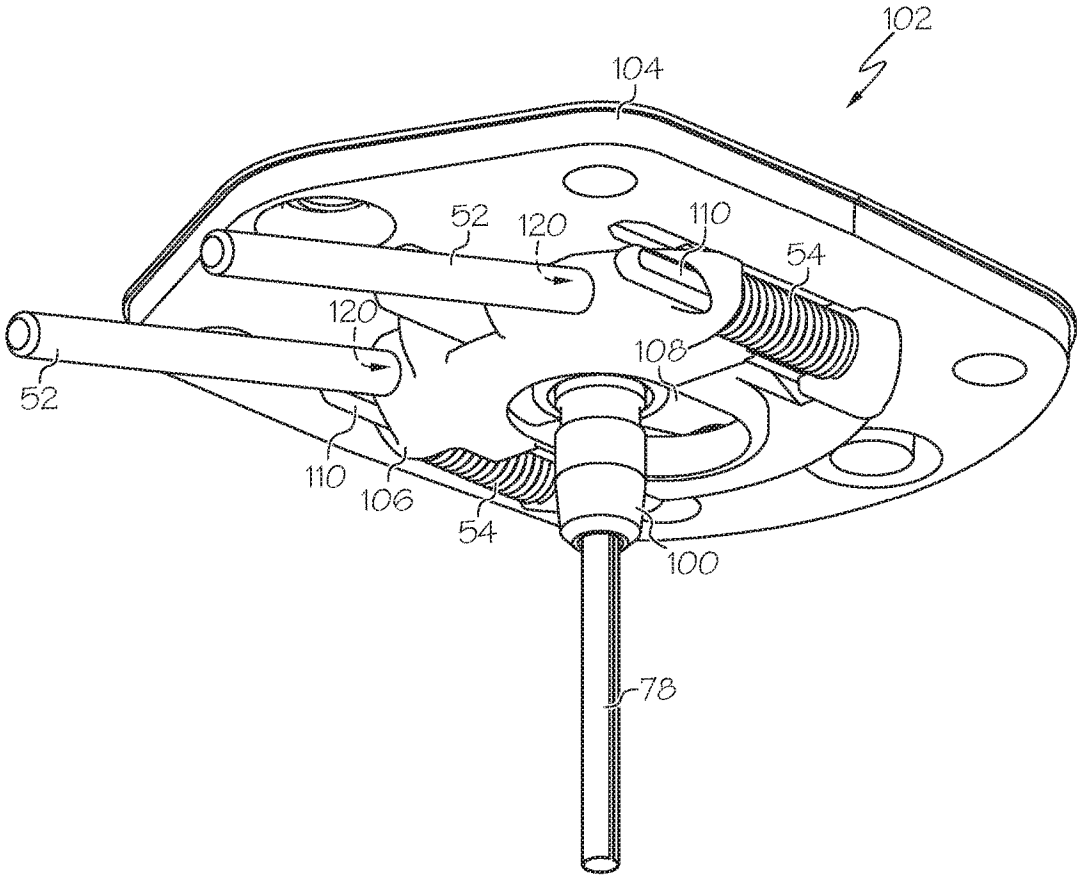
FIG. 10 illustrates the components of FIG. 9 with the pushrods in their retracted positions.

The actuator 46/engagement body 48, actuator guide 50 and pushrods 52 are all movable between an extended position (FIGS. 2 and 3) and a retracted position (FIGS. 4 and 5). The actuator 46/engagement body 48, actuator guide 50 and pushrods 52 are spring biased to their extended position by a pair of interlock springs 54 (FIGS. 9 and 10). Thus when the actuator 46/engagement body 48 is in in its extended position the actuator guide 50 and pushrods 52 are correspondingly in their extended positions.

When the nozzle 18 is sufficiently inserted into a fluid receptacle such as a fill pipe 26 as shown FIG. 5, the bellows/engagement body 48 contacts the fluid receptacle 30 (in this or other cases, portions of the fill pipe 26 can be considered part of the fluid receptacle 30). The engagement body 48 is compressed, and sufficient insertion of the nozzle 18 moves the actuator guide 50 and pushrods 52 away from a distal end of the spout 36 to their retracted position, as shown in FIGS. 4 and 5. Thus when the actuator 46/engagement body 48 is in its retracted position the actuator guide 50 and pushrods 52 are corresponding moved to their retracted position. The actuator 46 is thus configured to detect when said nozzle 18/spout 36 is sufficiently inserted into a fluid receptacle 30/fill pipe 26.

In some cases the engagement body 48 is generally sealed/closed and utilized to capture vapors which may escape from the fluid receptacle 30 during refueling, and route the captured vapors to a vapor recovery system, and the engagement body 48 can take the form of traditional bellows. However, the engagement body 48 need not necessarily be sealed, particularly if the nozzle 18 does not utilize a vapor recovery system, and in fact the actuator 46 need not utilize any bellows. Instead the engagement body 48 may take the form of structure (such as a generally cylindrical body, or a ring positioned at the end of a set of rods, etc.) configured to engage the fluid receptacle 30 and move away from a distal end of the nozzle 18/spout 36 when the fluid receptacle 30 is engaged.

Shut-Off Device

With reference to FIG. 4, the nozzle 18 can include a venturi poppet, poppet valve or suction generator 54 positioned in the fluid path 22, downstream of the fluid valve 38. A venturi poppet spring 56 engages the venturi poppet 54 and urges the venturi poppet 54 to a closed position (FIGS. 2-5) wherein the venturi poppet 54 engages an annular seating ring 58. When fluid of a sufficient pressure is present in the fluid path 22 upstream of, and acting on, the venturi poppet 54 (i.e., during dispensing operations), the force of the venturi poppet spring 56 is overcome by the pressure of the dispensed fluid and the venturi poppet 54 is moved to its open position, away from the seating ring 58, as shown in FIG. 6.

When the venturi poppet 54 is open and liquid flows between the venturi poppet 54 and the seating ring 58, a venturi effect is created in a plurality of passages 60 extending through the seating ring 58. The passages 60 are, in one case, generally radially extending, and in fluid communication with a sensing path or suction path 62 formed in the nozzle 18. The suction path 62 is in turn in fluid communication with a suction chamber 64 of a shut-off valve/device 60. Thus the venturi poppet 54 positioned in the fluid path 22 is configured such that when fluid of a sufficient pressure flows through the fluid path 22 the venturi poppet 54 is opened and creates a negative pressure in the suction path 62 by a venturi effect. Suction forces can also be generated in the suction path 62 by any of a variety of other arrangements that can, in some cases, utilize pressure/forces applied by fluid flowing though the nozzle 18, and the suction generator 54 can include or take the form of such other arrangements.

The suction path 62 includes and/or is in fluid communication with a suction tube 68 positioned within the spout 36. The suction tube 68 terminates at, and is in fluid communication with, an opening 70 positioned on the underside of the spout 36 at or near the distal end thereof. The suction tube 68, and other portions of the nozzle 18 exposed to the suction/venturi pressure, form or define the suction path 62 which is fluidly isolated or generally fluidly isolated from the fluid path 22.

The shut-off device 66 includes a cap 72 and a diaphragm 74 generally defining the suction chamber 64 therebetween. The diaphragm 74 can be relatively thin, and generally flat and planar. The shut-off device 66 also includes a vacuum cap spring 76 positioned above the diaphragm 74, urging the diaphragm 74 to a lower position. The shut-off device 66 further includes a latch pin 78 coupled to the diaphragm 74 by a nut 80 and washer 82 (See FIGS. 11-16) and oriented perpendicular thereto. The latch pin 78 is received in a latch plunger 84. When the latch pin 78 is in a lower position, the latch pin 78 and latch plunger 84 are rigidly coupled together (e.g. by a three-ball coupling arrangement 86, as described in greater detail below), and the latch plunger 84 provides a pivot/lever point about which the lever 44 can pivot. Thus, when the latch pin 78 is lowered the nozzle 18 can be operated to dispense fluid, and the shut-off device 66 is in open or operating configuration. In contrast, when the latch pin 78 is raised, the latch pin 78 is not rigidly coupled relative to the latch plunger 84. In this case, the latch plunger 84 does not provide a pivot/lever point about which the lever 44 can pivot, and dispensing operations are terminated or prevented and the shut-off device 66 is in a closed or non-operating configuration.

When the lever 44 is raised and the nozzle 18 is dispensing fluid (e.g. in the configuration shown in FIG. 6), the venturi poppet 54 is open and fluid can flow through the fluid path 22. In this case the venturi or negative pressure in the passages 60 and the suction path 62 draws air through the opening 70 and suction tube 62, thereby dissipating the negative pressure. When the opening 70 at the end of the spout 36 is blocked, such as when liquid levels in the tank 30 reach a sufficiently high level that the opening 70 is submerged in liquid, the negative pressure in the suction path 62 is no longer dissipated, and the negative pressure is applied to the suction chamber 64.

Figure 7:
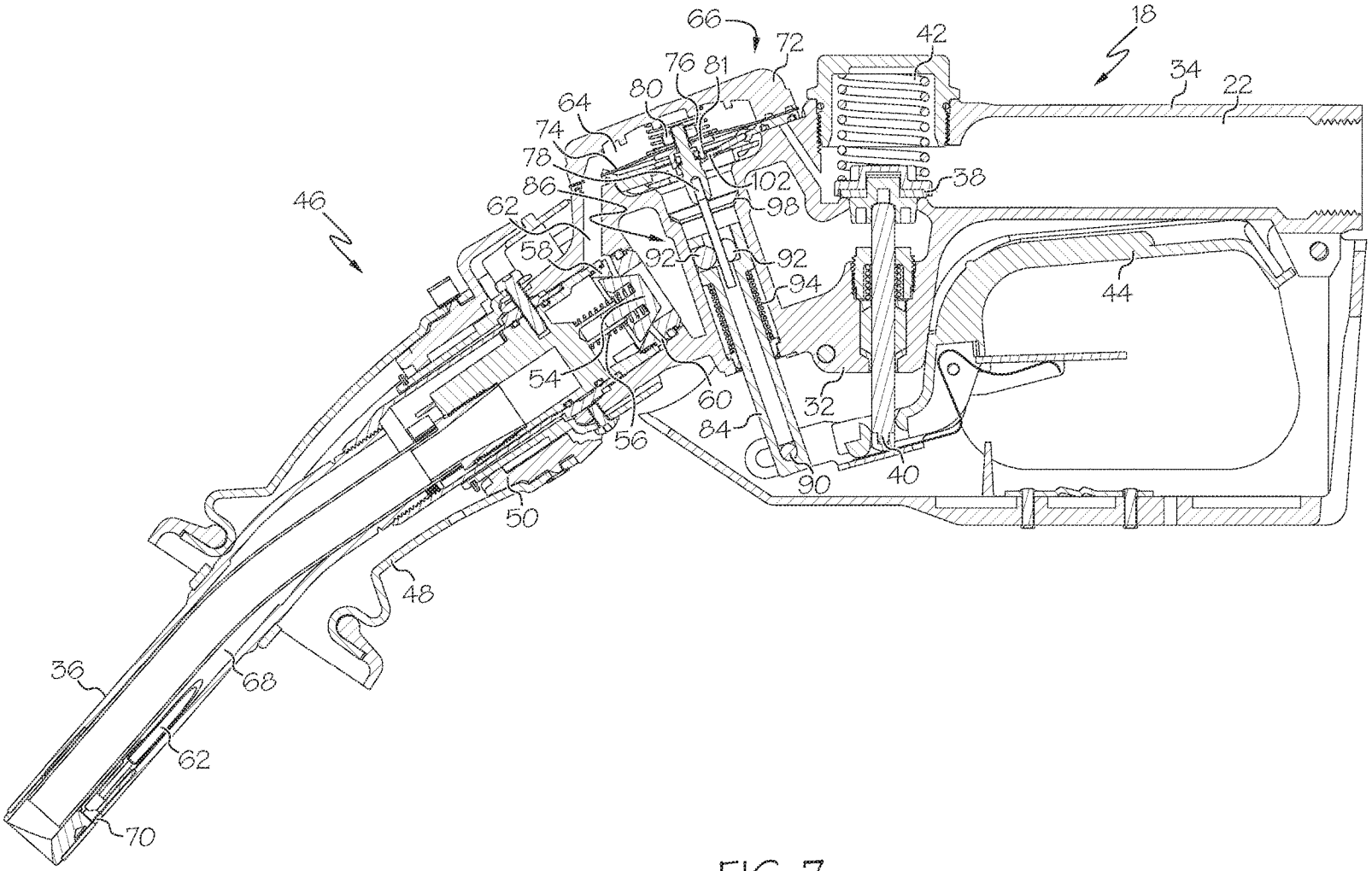
FIG. 7 illustrates the nozzle of FIG. 6 with the fluid valve closed by the shut-off device.

The decrease in pressure in the suction chamber 64 of the shut-off device 66 causes the diaphragm 74 to move upwardly. Since the latch pin 78 is coupled to the diaphragm 74, movement of the diaphragm 74 upwardly caused the latch pin 78 to move upwardly relative the latch plunger 84. The upward movement of the latch pin 78 releases the rigid connection between the latch pin 78 and the latch plunger 84, enabling the latch plunger 84 to move along its axis. Such freedom of movement of the latch plunger 84 along its axis causes the lever 44 to lose its leverage/pivot point and/or the latch plunger 84 to be pulled downwardly away from the nozzle body 32, as shown in FIG. 7. In this state the valve stem 40 and fluid valve 38 are lowered, as biased by the fluid valve spring 42, causing the fluid valve 38 to close and stopping dispensing operations. In this manner when the suction path 62 is blocked during fluid dispensing the shut-off device 66 moves to its closed configuration to block the nozzle 18 from dispensing fluid through the fluid path 22.

Thus the shut-off device 66 utilizes the negative pressure generated by the venturi poppet 54 to provide a shut-off feature which terminates refueling/fluid dispensing when liquid is detected at the tip of the spout 36. Further details relating to these features can be found in U.S. Pat. No. 4,453,578 to Wilder, the entire contents of which are hereby incorporated by reference, and U.S. Pat. No. 3,085,600 to Briede, the entire contents of which are incorporated herein.

Latch Pin Coupling

Figure 2:
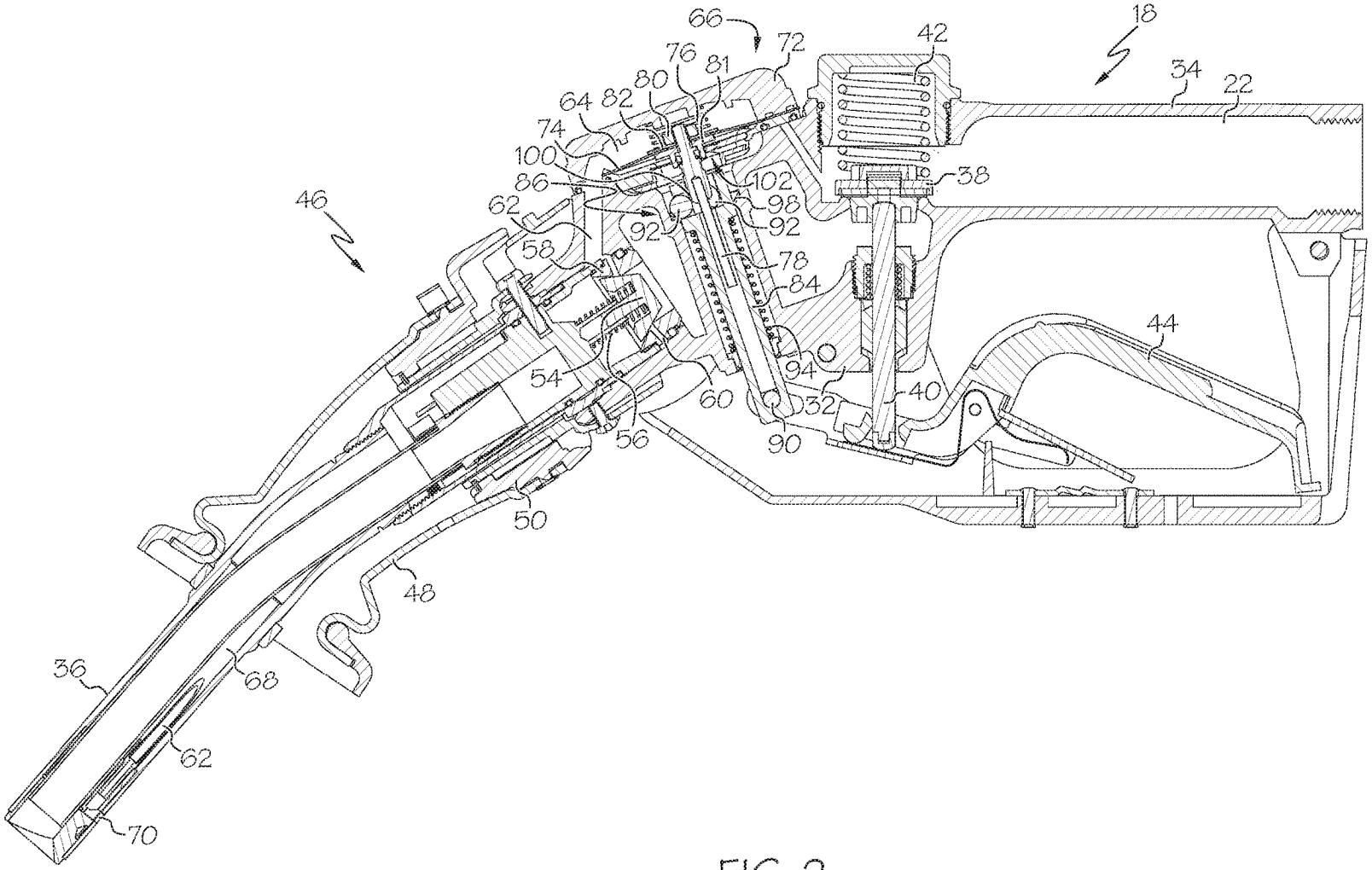
FIG. 2 is a mid-plane cross section of a nozzle of the system of FIG. 1, shown in its normal, resting configuration.

As outlined above, a latch pin coupling 86, such as a three-ball coupling arrangement, can be utilized to selectively couple the latch pin 78 to the latch plunger 84. With reference to FIGS. 2 and 3, the latch pin 78 extends downwardly through, and protrudes outwardly from, the diaphragm 74/shut-off device 66. In one case, as shown in FIGS. 11, 12, 14 and 15, the latch pin 78 is coupled to the diaphragm 74 by a nut 80 threaded onto an upper end of the latch pin 78. A washer 82 can be positioned on the upper side of the diaphragm 74, and a washer-shaped diaphragm support 81 can be positioned on the lower side of the diaphragm 74 (and/or in one case the diaphragm support 81 can be considered to be part of the diaphragm 74). Returning to FIGS. 2 and 3, the lower end of the pin 78 is movably received in the latch plunger 84 which extends downwardly through, and protrudes outwardly from, the nozzle body 32. The pin 78 and latch plunger 84 are each slidably mounted within the nozzle body 32. The lower end of the latch plunger 84 is pivotally coupled to a distal end of the lever 44 at pivot connection 90. A set of three balls 92 (two of which are shown in FIG. 2) are positioned within passages in the upper end of the latch plunger 84 and spaced apart radially by one hundred and twenty degrees. The balls 92 can be radially movable relative to a body of the latch plunger 84, but are trapped in a passageway and generally not axially movable relative to the body of the latch plunger 94. The latch plunger 84 is biased into its upper position by a spring 94 which has a weaker spring force than the spring force of the fluid valve spring 42.

Figure 8:
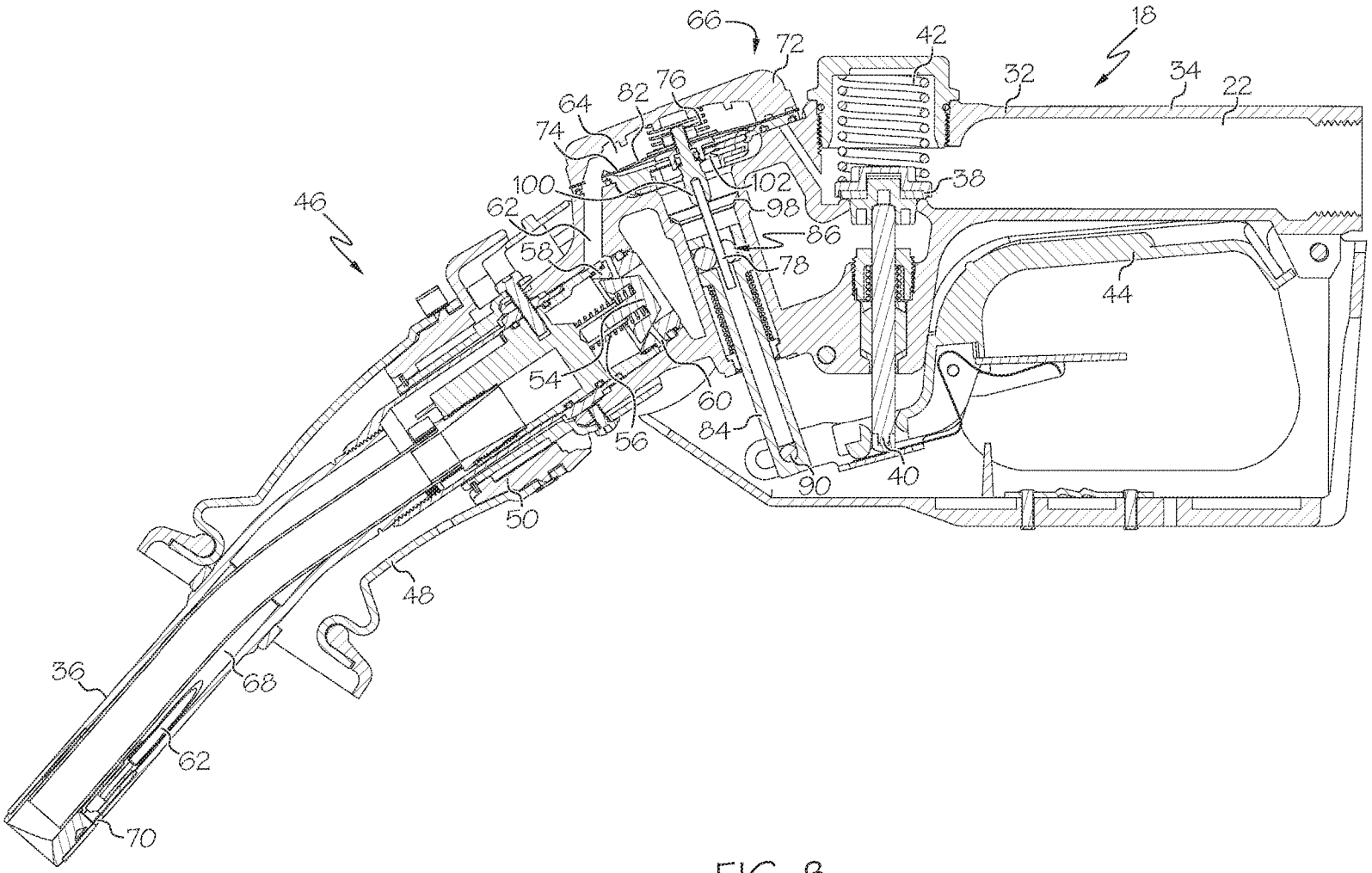
FIG. 8 illustrates the nozzle of FIG. 6 with the fluid valve closed by the interlock.

When the pin 78 is in its upper position as shown in FIG. 2, the balls 92 have the ability to move radially inwardly. In this position any attempted opening of the fluid valve 38 by raising the actuator 44 will cause the latch plunger 84 to be pulled away from the nozzle body 32, as shown in FIG. 8. In contrast, when the pin 78 is in its lower position as shown in FIGS. 4 and 5, the lower positioning of the pin 78 presents a thicker portion 100 of the pin 78 (See FIG. 10) between the balls 92. The thicker portion 100 moves the balls 92 radially outwardly and blocks the balls 92 from moving radially inwardly. In this position any attempted downward movement of the latch plunger 84 would cause the balls 92 to engage a lip 98 of the nozzle body 32, thereby preventing downward movement of the latch plunger 84.

In this case, then, when the diaphragm 74 is in its lower position the latch plunger 84 is rigidly held in place, and acts as a pivot point such that a user can manually operate the lever 44 to dispense fluid. In contrast, when the diaphragm 74 is in its upper position (such as when, during dispensing operations, fluid is detected at the tip of the spout 70), the latch plunger 84 is not rigidly held in place, and instead is movable downward, stopping or preventing a user from manually operating the nozzle 18 to dispense fluid. Additional details relating to the latch pin coupling 86 are included is included in U.S. Pat. No. 2,582,195 to Duerr, the entire contents of which are incorporated herein.

Interlock

The nozzle 18 can also include an interlock, generally designated 102, which is configured to prevent the nozzle 18 from dispensing fluid unless the nozzle 18/spout 36 is sufficiently inserted into the fluid receptacle 30/fill pipe 26. The interlock 102 can include and/or be operatively coupled to the actuator 46 described above.

With reference to FIGS. 9-16, the interlock 102 includes an interlock body 104 fixedly coupled to the nozzle body 32, a slider 106 slidably coupled to the interlock body 104, and an arm 108 pivotally coupled to the interlock body 104. The slider 106 is laterally movable (e.g. in a direction parallel to a plane of the diaphragm 74/interlock body 104) between an extended position, shown in FIGS. 9 and 11-13, and a retracted position shown in FIGS. 10 and 14-16. The interlock 102 includes the pair of interlock springs 54 positioned between the slider 106 and the interlock body 104 and mounted on spring guide arms 110, which bias the slider 106 to its extended position. The slider 106 includes an engagement surface 112, which is shown as angled or ramp-shaped in the illustrated embodiment and positioned at an angle relative to the direction of movement of the slider 106 and/or a plane of the diaphragm 74. However if desired the engagement surface 112 could have various other shapes, such as curved.

Figure 13:
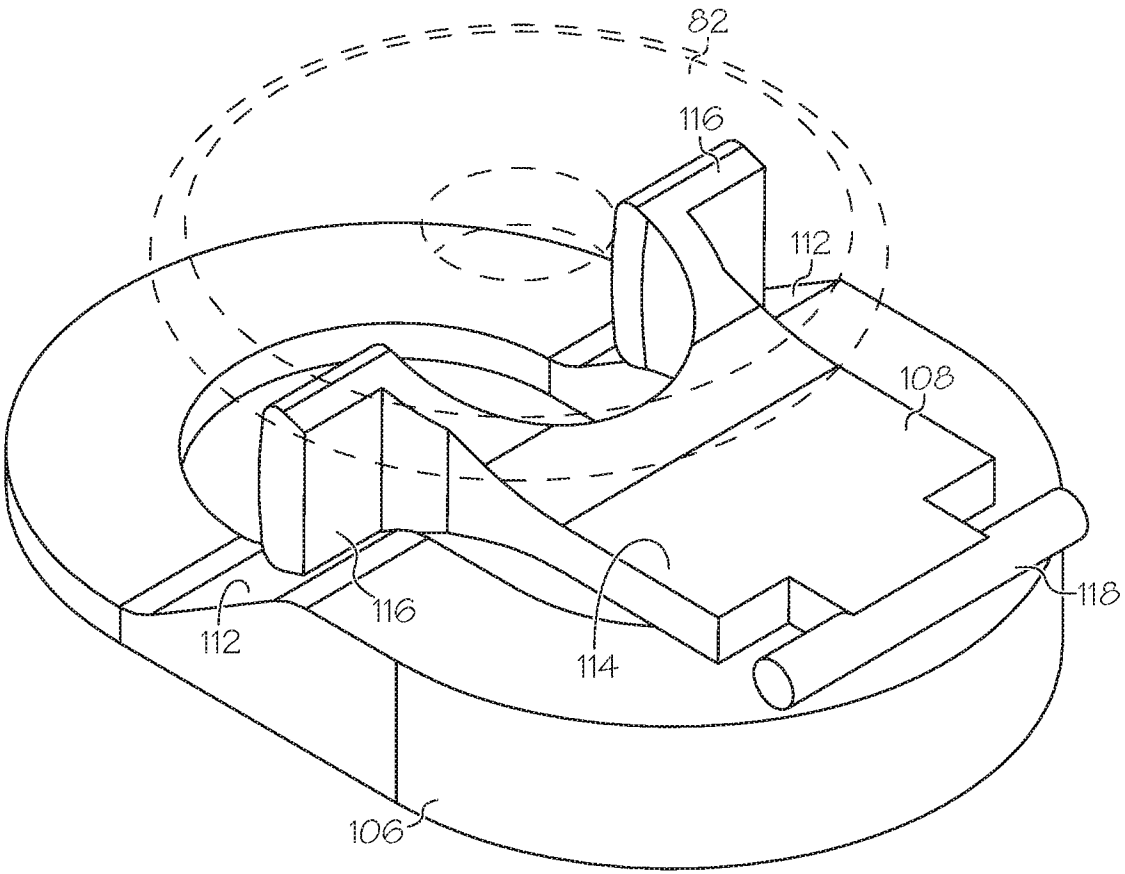
FIG. 13 is an upper perspective view of the arm and slider of the interlock of FIGS. 11 and 12.
Figure 14:
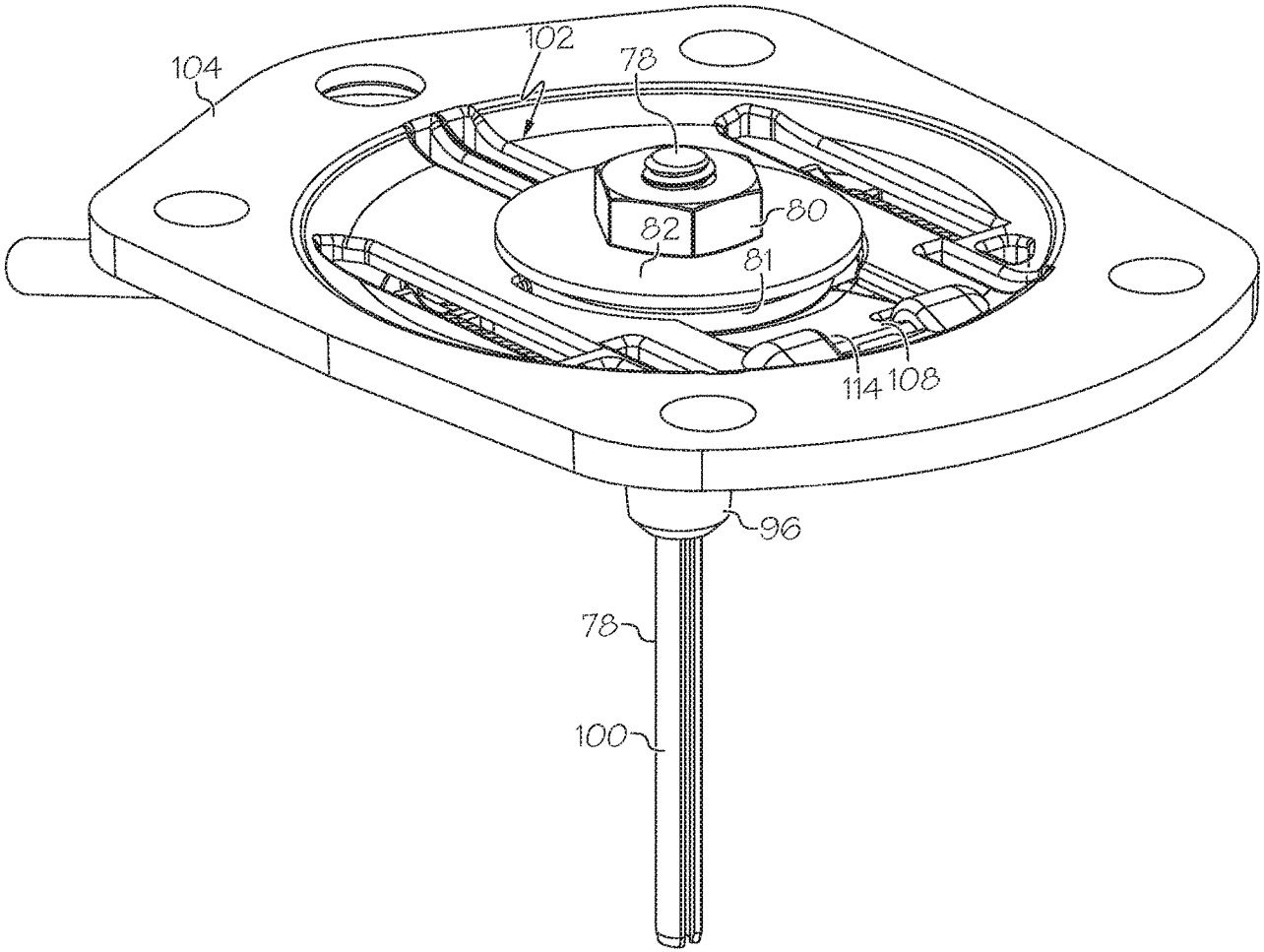
FIG. 14 is an upper perspective view of the interlock of FIGS. 9 and 10 in its engaged position.
Figure 15:
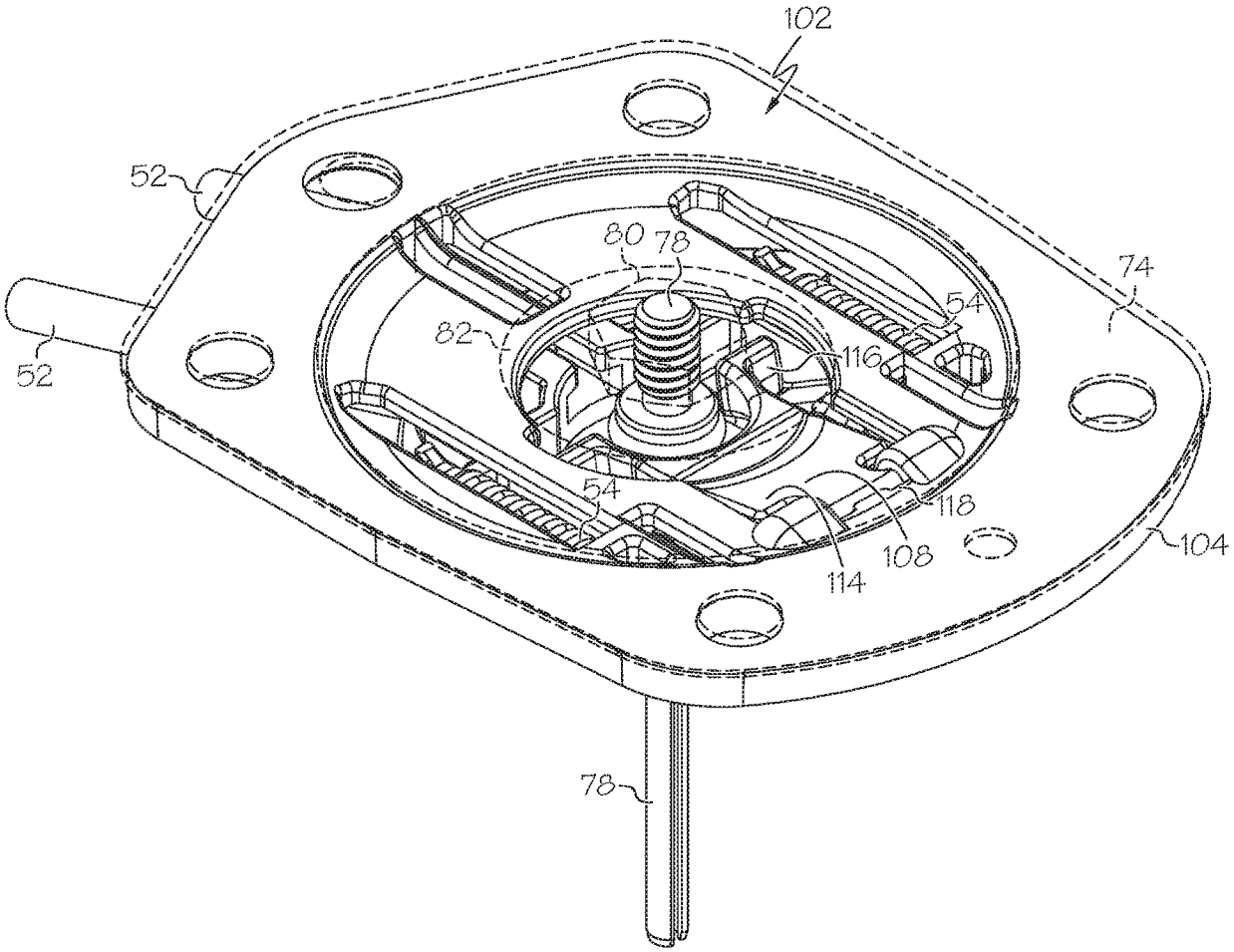
FIG. 15 is an upper perspective view of the interlock of FIG. 14, with the washer and nut shown in hidden lines.
Figure 16:
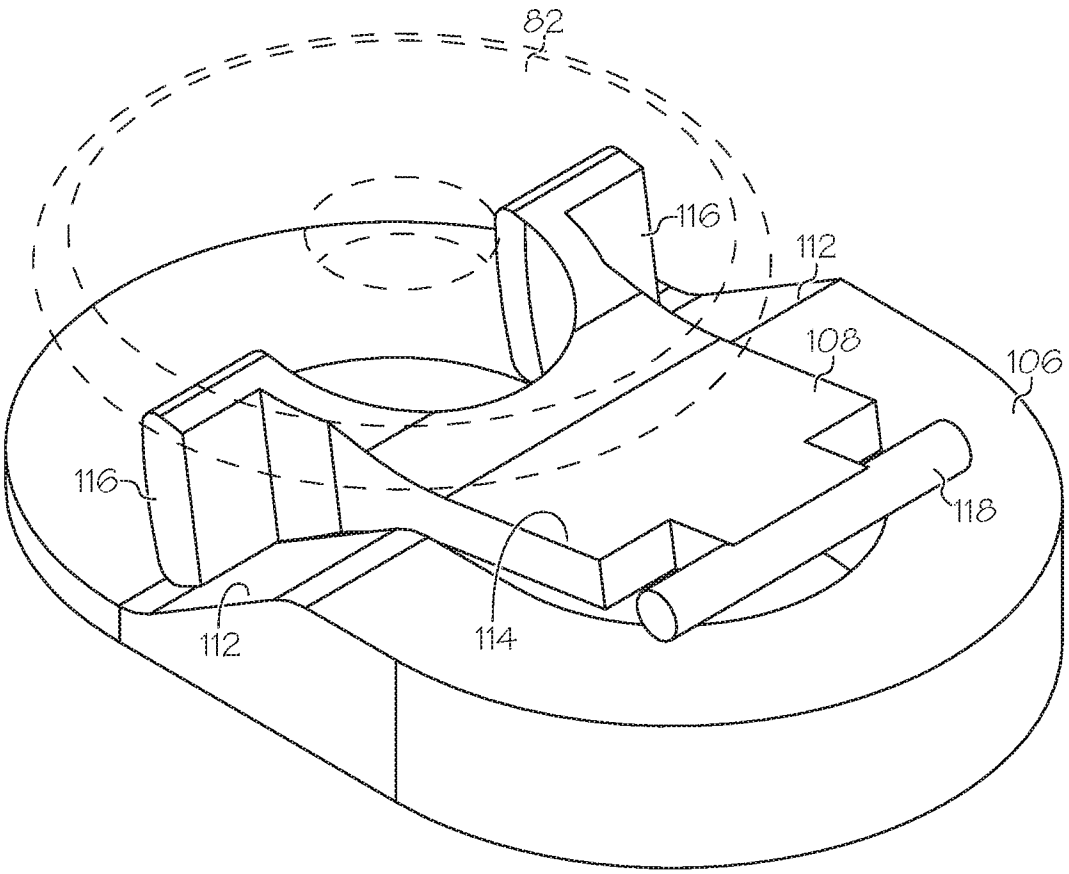
FIG. 16 is an upper perspective view of the arm and slider of the interlock of FIGS. 14 and 15.

The arm 108 is generally "U" shaped in top view and includes an arm base 114 and a pair of spaced apart arm portions 116 forming the legs of the "U" shape. The arm 108 includes a pivot arm 118 secured to the interlock body 104, about which the arm 108 can pivot. The arm 108 is thus pivotable about an axis oriented generally parallel to a plane of the diaphragm 74 and/or a plane defined by sliding movement of the slider 106. With reference to FIGS. 13 and 16, the distal ends of the arm portions 116 rest upon, and are in sliding contact with, the slider 106, and more particularly the engagement surface 112 of the slider 106 for all or at least part of the range of motion of the slider 106. When the slider 106 is in its extended position the arm 108 is in its upper position (FIGS. 14-16).

In contrast, when the slider 106 is in its retracted position, the engagement surface 112 presents an area of decreased thickness to the arm 108, causing the arm 108 to pivot to its lower position (FIGS. 11-13), as biased by the diaphragm 74 which is in turn biased downwardly by the vacuum cap spring 76. In this manner slidable movement of the slider 106 in a direction generally parallel to the diaphragm 74 presents portions of the slider 106 having a greater (or lesser) dimension in a direction perpendicular to the diaphragm 74/direction of movement, causing the arm 108 to pivot. The slider 106 is thus in slidable engagement with the arm 108 such that the slider 106 moves in translation relative to the arm 108 across a surface of the arm 108.

As outlined above, the actuator 46 includes a pair of pushrods 52 that are movable between an extended position (FIGS. 3 and 9) and a retracted position (FIGS. 5 and 10). The slider 106 is operatively coupled to the pushrods 52 and actuator 46 such that movement of the actuator 46/pushrods 52 causes corresponding sliding movement of the slider 106 between its extended and retracted positions. In particular, in the embodiment of FIG. 10, the slider 106 includes a pair of opposed recesses 120, each of which receives a distal end of a pushrod 52 therein to couple the pushrods 52 to the slider 106. However, the slider 106 and pushrods 52 can be coupled by any of a variety of other manners or structures. Since the slider 106 and pushrods 52 are operatively coupled together, the interlock springs 54 thus bias the pushrods 52, actuator guide 50, engagement body 48 and actuator 46 to their extended positions.

Figure 11:
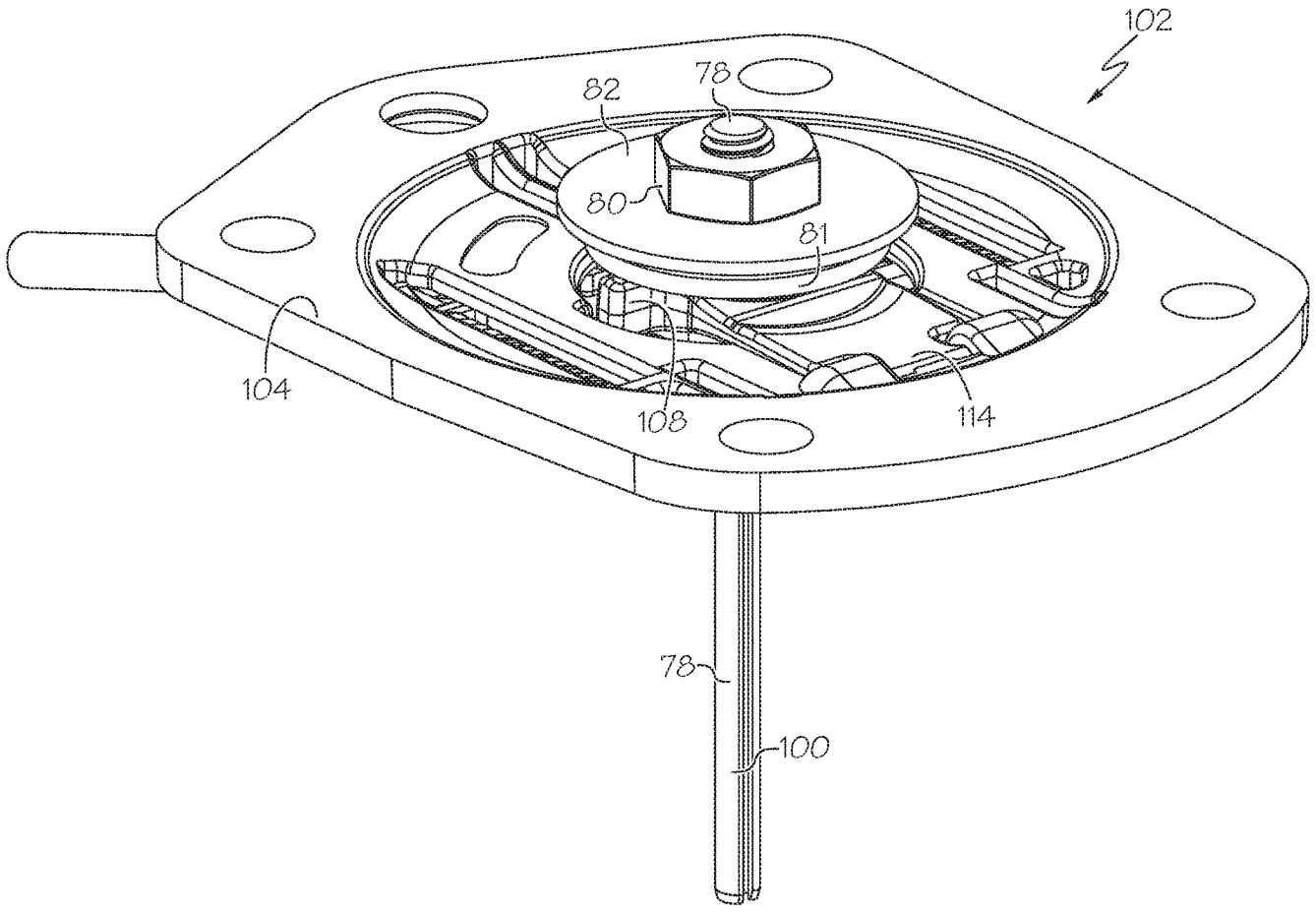
FIG. 11 is an upper perspective view of the interlock of FIGS. 9 and 10 in its disengaged position.
Figure 12:
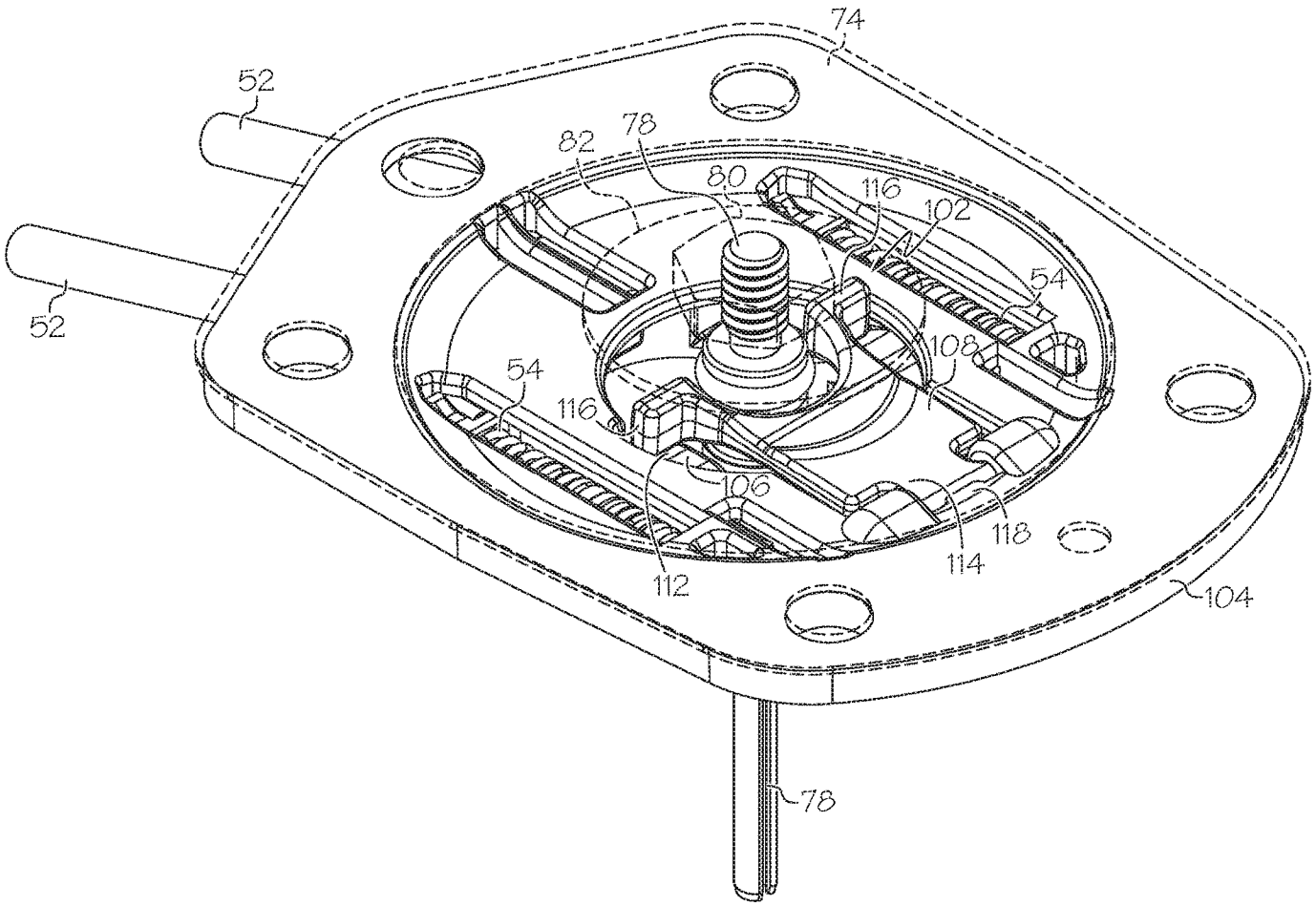
FIG. 12 is an upper perspective view of the interlock of FIG. 11, with the washer and nut shown in hidden lines.

FIG. 3 illustrates the nozzle 18 before refilling conditions have commenced, and in particular before the nozzle 18/spout 36 is inserted into any refill pipe 26/fluid receptacle 30. In this case actuator 46, pushrods 52 and slider 106 are all in their extended positions, which causes the arm 108 to be in its raised position. As shown in FIGS. 11 and 12, when the arm 108 is in its raised position, the arm 108 engages and raises the diaphragm support 81 and diaphragm 74. As outlined above in the "Latch Pin Coupling" section, when the diaphragm 74 is raised, the latch pin coupling 86 (FIG. 2) decouples the latch pin 78 from the latch plunger 84, preventing operation of the lever 44 to open the fluid valve 38 and thereby preventing or terminating dispensing operations. The interlock 102 is thus in its disengaged position when the actuator 46, pushrods 52 and slider 106 are in their extended positions, as shown in FIGS. 2, 3, 9 and 11-13.

In contrast, FIG. 5 illustrates the nozzle 18 when the nozzle 18/spout 36 are sufficiently inserted into the refill pipe 26/fluid receptacle 30. In this case actuator 46, pushrods 52 and slider 106 all move to their retracted position due to compression of the bellows/engagement surface 48 engaging the fluid receptacle 26/30, which causes the arm 108 to move to its lower position. The interlock 102 is thus in its engaged position when the actuator 46, pushrods 52 and slider 106 are in their retracted positions, as shown in FIGS. 4, 5, 10 and 14-16. In other words when the nozzle 18/spout 36 is sufficiently inserted into the fluid receptacle 26/30 the slider 106 is moved laterally relative to the diaphragm 74 in a direction parallel thereof, and the arm 108 is pivoted to cause the diaphragm 74 to move downwardly in a direction generally perpendicular to a plane of the diaphragm 74, enabling fluid dispensing.

When the nozzle 18/spout 36 is removed from the fluid receptacle 26/30, the actuator 46, pushrods 52 and slider 106 all return to their extended positions, as biased by the interlock springs 54 and vacuum cap spring 76, and the diaphragm 74 and latch pin 78 are raised, as shown in FIG. 8. Thus, the interlock 102 prevents the nozzle 18 from dispensing fluid when the nozzle 18 is not sufficiently inserted into a receptacle, and enables the nozzle 18 to dispense fluid when the nozzle 18 is sufficiently inserted into the fluid receptacle.

The interlock 102 helps to ensure fluid is only dispensed when the nozzle 18 is properly situated. If the lever 44 were attempted to be operated when the nozzle 18 is not properly inserted, fluid is prevented from being dispensed. The interlock 102 can also prevent any dripping or spitting when dispensing operations are ceased, which can prevent any drips from landing on the operator, vehicle/receptacle or ground surface, preventing wasted fuel and potentially adverse environmental effects. As noted above, the nozzle 18 may in some cases lack any bellows and lack any vapor recovery system which traditionally uses bellows, and in this case some other sort of actuator 46 can be utilized. It should also be understood that the nozzle 18 can either include or lack a no-pressure no-flow valve.

As shown in FIGS. 11-16, the arm 108 is symmetrically positioned with respect to both the slider 106 and the latch pin 28/diaphragm 74, and with respect to a central axis along the longitudinal axis of the nozzle 18. The arm portions 116 of the arm 108 are positioned on opposite sides of the latch pin 78 and/or the operative center of the diaphragm 74. In this manner the slider 106 applies a symmetrical force to the arm 108, and the arm 108 applies a symmetrical force to the diaphragm 74/diaphragm support 81 during an entire range of motion of the arm 108. The symmetrical loading(s) help to provide smoother movement of the arm 108 and the diaphragm 74/diaphragm support 81 by preventing canting of the diaphragm 74/diaphragm support 81 and preventing a moment or torque from being applied to the diaphragm 74/diaphragm support 81/washer 82 that could cause friction or binding.

Figure 17:
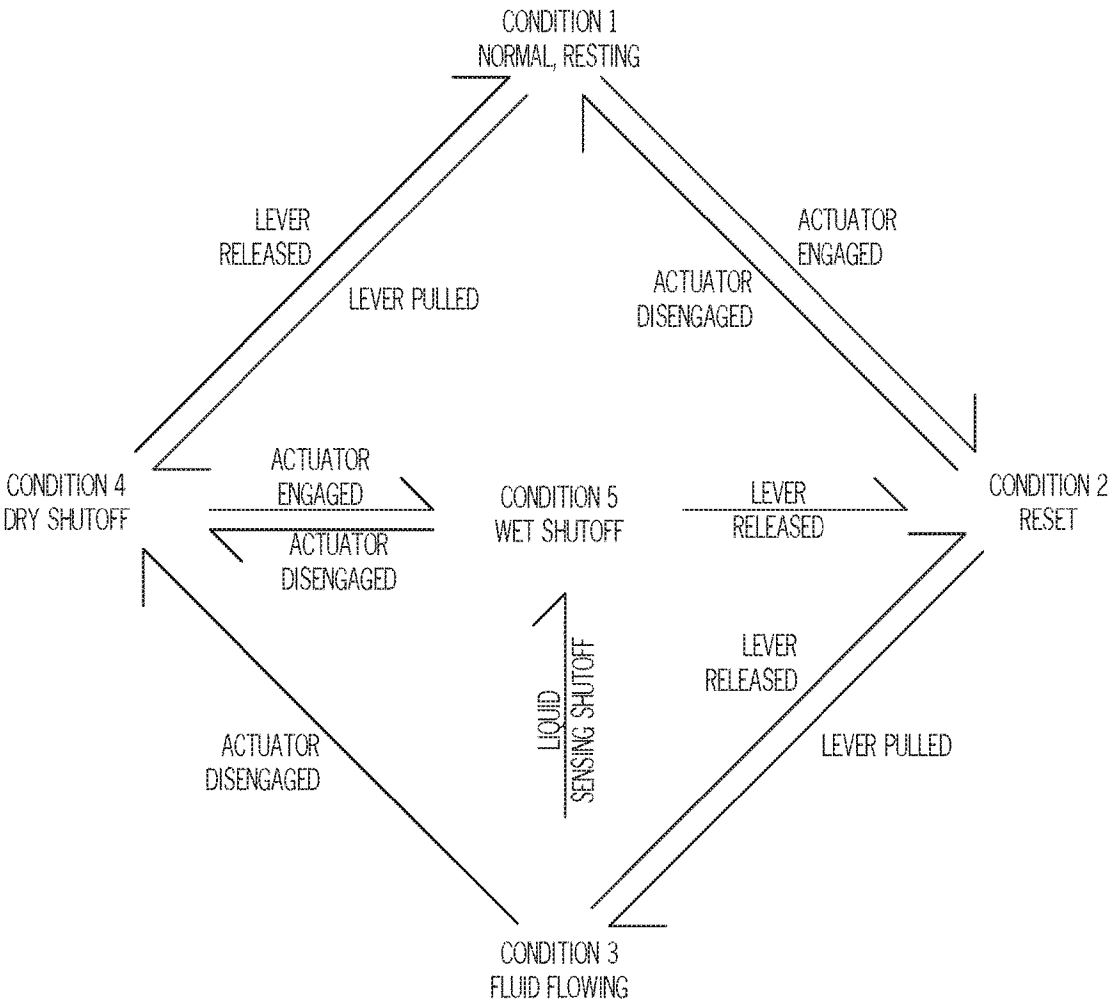
FIG. 17 is a graphic illustration of the various conditions of the nozzle and their relationships relative to each other.

In the illustrated embodiment the arm 108 engages, and slides along, an underside of the support 81, which is in turn rigidly coupled to the diaphragm 74. In this manner the arm 108 can be spaced away from, and does not engage, the diaphragm 74 during an entire range of motion of the arm 108. By spacing the arm 108 away from the diaphragm 74 (which can be made of plastic/polymer material), any wear and tear the arm 108 may impart to the diaphragm 74 is eliminated. Instead the arm 108 engages and slides along the support 81, which can be more durable and robust than the diaphragm 74 and may be more easily replaced. In this case then the arm 108 can indirectly apply forces to the diaphragm 74 to raise the diaphragm 74. In addition, the slider 106 can be in contact with the arm 108 for an entire range of motion of the slider 106/arm 108, and the slider 106 is in contact with the arm 108 when the actuator 46 is in its extended position. By ensuring there is no gap between the slider 106 and arm 108 the chance of any components, debris or the like becoming positioned between the slider 106 and arm 108, which can prevent proper functioning thereof, is reduced or minimized Operation Overview The operation of the nozzle 18, and movement between various conditions, is now described. FIG. 17 schematically illustrates the movement of the nozzle 18 between, and relationship between, the various condition.

FIGS. 2 and 3 illustrate the nozzle 18 in its normal, resting condition in which the nozzle 18 is not inserted into a fill pipe 26 and is not dispensing fuel ("Condition 1—Normal Resting"). In this case the interlock springs 54 urge the actuator 46 to its forward position, toward the tip of the spout 36. As outlined above, when the actuator 46 is in the position shown in FIGS. 2 and 3, the diaphragm 74 and pin 78 are in their upper positions, such that the pin 78 does not engage the latch pin coupling 86 (i.e. three-ball coupling arrangement 86), and the pin 78 is not coupled to the latch plunger 84. In this case, then, if the lever 44 were to be raised/actuated, the nozzle 18 moves to the configuration shown in FIG. 8 ("Condition 4—Dry Shutoff") wherein movement of the lever 44 pulls the latch plunger 84 downwardly and away from the nozzle body 32, and the fluid valve 38 remains closed.

Alternatively, when the nozzle 18 is in the condition shown in FIGS. 2 and 3, if the nozzle 18 is properly inserted into a fill pipe 26 or fuel receptacle 30, the actuator 46 contacts the fill pipe 26 or fuel receptacle 30. With a slight force, when the nozzle 18 is further inserted into the fill pipe 26, the interlock springs 54 are compressed, which engages the actuator 46 and interlock 102, and the nozzle 18 is moved to the configuration shown in FIGS. 4 and 5 ("Condition 2—Reset"). The nozzle 18 can be inserted sufficiently into the fill pipe 26 such that the weight of the nozzle 18 hooks an anchor ring 122 of the spout 18 to the inside of the fill pipe 26 (FIG. 5), holding the interlock springs 54 in their compressed position and preventing the nozzle 18 from falling out of the fill pipe 26.

In this configuration, the slider 106 moves to its retracted position, away from the spout 36 which enables the vacuum cap spring 76 to push the diaphragm 74 and arm 108 to their lower positions. When the diaphragm 74 moves to its lower position, the pin 78 also moves to its lower position and engages the latch pin coupling 86, locking the pin 78 relative to the latch plunger 84. From this Condition 2, if the lever 44 is raised, the lever 44 pivots about the fixed pivot point 90, and raises the fluid valve stem 40, opening the fluid valve 38 and the nozzle 18 moves to the configuration shown in FIG. 6 ("Condition 3—Fluid Flowing"). Alternatively, from Condition 2, if the nozzle 18 is removed from the vehicle, the interlock springs 54 return the actuator 46 and the nozzle 18 moves back to Condition 1.

In Condition 3 (FIG. 6) the lever 44 can be held open manually or by a hold-open device. The latch pin coupling 86 is engaged and the fluid valve 38 is open, which allows fluid to be dispensed. From Condition 3, the nozzle 18 can transition into three different conditions, as shown in FIG. 17. The first possibility occurs when the lever 44 is released, and in this case the fluid valve 38 closes, which stops fluid flow and the nozzle 18 returns to Condition 2 (FIGS. 4 and 5). The second possibility from Condition 3 is that the nozzle 18 is removed from the vehicle 28, which causes the actuator 46 to return to its extended position, as biased by the interlock springs 54. This, in turn, causes the slider 106 to move to its extended position, which raises the diaphragm 74 and pin 78. This upward movement of the diaphragm 74 and pin 78 movement releases the latch pin coupling 86, freeing the latch plunger 84, and the force of the fluid valve spring 42 closes the fluid valve 38 and stops fluid from flowing through the fluid path 22. In this manner the nozzle 18 is placed in Condition 4 ("Dry Shutoff"), as shown in FIG. 8.

The final possibility, when the nozzle 18 begins in Condition 3, occurs when the shut-off device 66 senses fluid at the tip of the spout 36 through opening 70. In this case, the venturi poppet 54 evacuates air from the suction chamber 64 of the shut-off device 66. When the differential pressure on the diaphragm 74 is greater than the force of the vacuum cap spring 76, the diaphragm 74 rises, which pulls the latch pin 78 away from the latch plunger 84 and disengages the latch pin coupling 86. This causes the fluid valve 38 to close and the nozzle 18 is placed into Condition 5 ("Wet Shutoff"), shown in FIG. 7.

FIG. 8 shows the nozzle 18 in Condition 4 in which the actuator 46 is disengaged and the lever 44 is manually held open, but in this case no fluid flows because the latch pin coupling 86 is not engaged since the actuator 46 is disengaged (i.e. the nozzle 18 is not sufficiently inserted into a vehicle). If the actuator 46 is engaged while the nozzle 18 is in Condition 4, the nozzle 18 moves to Condition 5 (FIG. 7).

When the nozzle 18 is in Condition 5 (FIG. 7) the actuator 46 is engaged and the lever 44 is held open, but no fluid flows because, for example, the nozzle 18 has experienced a wet shut-off. When, from Condition 5, if the lever 44 is released, the nozzle 18 returns to Condition 2 and is ready to dispense fluid again. In contrast, from Condition 5, if the actuator 46 is disengaged (i.e. the nozzle 18 is retracted from the fill pipe) then the nozzle 18 moves to Condition 4.

Thus the interlock 102 and related subsystems help to ensure the nozzle 18 operates safely and in the desired manner. In addition the disclosed interlock 102 is relatively easy to implement, is robust and utilizes a relatively low part count.

Having described the invention in detail and by reference to the various embodiments, it should be understood that modifications and variations thereof are possible without departing from the scope of the invention.

What is claimed is:

1. A nozzle for dispensing fluid comprising:

a nozzle body including a spout and fluid path through which fluid to be dispensed is flowable;

an actuator configured to detect when said spout is sufficiently inserted into a fluid receptacle;

a shut-off device configured to selectively terminate or prevent fluid dispensing through said fluid path; and an interlock operatively coupling said actuator to said shut-off device, said interlock including a slider that is operatively coupled to said actuator and a pivotable arm that is operatively coupled to said shut-off device, and wherein said slider is slidable along said pivotable arm.

2. The nozzle of claim 1 wherein said interlock includes an interlock body that is fixedly coupled to said nozzle body, and wherein said slider is slidable relative to said interlock body between an extended position and a retracted position in a plane thereof, and wherein said pivotable arm is pivotable about an axis oriented parallel to said plane.

3. The nozzle of claim 1 wherein said slider and said pivotable arm are in contact during an entire range of motion of said slider between said extended position and said retracted position.

4. The nozzle of claim 1 wherein said pivotable arm is pivotable between a first position which causes said shut-off device to be in a non-operating configuration in which said shut-off device terminates or prevents fluid dispensing through said fluid path, and a second position which causes said shut-off device to be in an operating configuration in which said shut-off device does not terminate or prevent fluid dispensing through said fluid path, and wherein said slider and said pivotable arm are in contact during an entire range of motion of said pivotable arm between said first position and said second position.

5. The nozzle of claim 1 wherein said actuator is configured to be in an extended position when said spout is not inserted into said fluid receptacle, and wherein said slider and said pivotable arm are in contact when said actuator is in said extended position.

6. The nozzle of claim 1 wherein said shut-off device includes a diaphragm and is configured to terminate or prevent fluid dispensing when liquid is detected at at least part of said spout, and wherein said pivotable arm is operatively coupled to said diaphragm.

7. The nozzle of claim 6 wherein said diaphragm is generally flat and planar, and wherein said pivotable arm is pivotable about an axis oriented generally parallel to said diaphragm.

8. The nozzle of claim 1 wherein said slider includes an angled or curved engagement surface, and wherein said pivotable arm is in operative contact with said engagement surface.

9. The nozzle of claim 8 wherein said pivotable arm and said slider are configured such that a distal end of said pivotable arm is in sliding contact with said engagement surface.

10. The nozzle of claim 8 wherein said engagement surface is angled or curved relative to a plane of movement of said slider.

11. The nozzle of claim 1 wherein said shut-off device includes a diaphragm, and wherein said pivotable arm and said slider are configured such that when said spout is not inserted into said fluid receptacle and is then sufficiently inserted into said fluid receptacle said slider is moved laterally relative to said diaphragm in a direction parallel thereof.

12. The nozzle of claim 1 wherein said shut-off device includes a diaphragm and wherein said pivotable arm and said slider are configured such that when said spout is not inserted into said fluid receptacle and is then sufficiently inserted into said fluid receptacle said pivotable arm is pivoted to cause said diaphragm to move in a direction generally perpendicular to a plane of said diaphragm.

13. The nozzle of claim 1 wherein said shut-off device includes a diaphragm and wherein said pivotable arm includes a pair of spaced apart arm portions configured to apply a force to move said diaphragm, wherein said arm portions are positioned on opposite sides of said diaphragm and symmetrically positioned with respect to a longitudinal axis of said nozzle.

14. The nozzle of claim 1 wherein said shut-off device includes a diaphragm and wherein the nozzle further includes a latch pin coupled to said diaphragm and a latch plunger which is operatively connectable to said latch pin depending upon a position of said diaphragm, wherein said diaphragm is oriented in a plane generally perpendicular to an axis of said latch plunger.

15. The nozzle of claim 1 wherein said shut-off device includes a diaphragm and wherein said shut-off device includes a diaphragm support rigidly coupled to said diaphragm, and wherein said pivotable arm is engageable with said diaphragm support to thereby move said diaphragm, and wherein said pivotable arm is spaced apart from and not in direct contact with said diaphragm during an entire range of motion of said pivotable arm.

16. The nozzle of claim 15 wherein said pivotable arm is configured to, when pivoted, apply a symmetrical force to said diaphragm support during an entire range of motion of said pivotable arm.

17. The nozzle of claim 15 wherein said diaphragm at least partially defines a generally sealed suction chamber of said shut-off device.

18. The nozzle of claim 1 wherein said shut-off device includes a diaphragm and wherein said nozzle further includes a latch pin coupled to said diaphragm, a latch plunger which is operatively connectable to said latch pin depending upon a position of said diaphragm, and a lever that is manually operable to control dispensing operations, wherein when said diaphragm is in a first position said latch pin is operatively connected to said latch plunger to enable said lever to be manually operated to dispense fluid, and wherein when said diaphragm is in a second position said latch pin is not operatively connected to said latch plunger such that said lever is not able to be manually operated to dispense fluid, and wherein said interlock is configured to maintain said diaphragm in said second position unless said actuator detects that said spout is sufficiently inserted into said fluid receptacle.

19. The nozzle of claim 1 wherein said actuator is configured to be in an extended position when said spout is not inserted into said fluid receptacle, and wherein said actuator is configured to move to a retracted position when said spout is sufficiently inserted into said fluid receptacle, and wherein said nozzle further includes a spring that is compressed by movement of said actuator from said extended position to said retracted position.

20. The nozzle of claim 1 wherein said actuator includes an engagement body extending generally circumferentially about said spout, wherein said engagement body is biased to an extended position and movable to a retracted position when said engagement body engages said fluid receptacle and said spout is sufficiently inserted into said fluid receptacle, wherein said engagement body is operatively coupled to said slider such that at least part of said movement of said engagement body from said extended position to said retracted position is transmitted to said slider to cause lateral movement of said slider.

21. The nozzle of claim 1 wherein the shut-off device includes a diaphragm defining a diaphragm plane, and wherein the slider has an engagement surface that has a variable distance to the diaphragm plane along a length of the slider.

22. The nozzle of claim 21 wherein the engagement surface is angled or curved relative to the diaphragm plane.

23. The nozzle of claim 1 wherein the slider presents a variable thickness to said pivotable arm when said slider slides along said pivotable arm.

24. The nozzle of claim 1 wherein said slider is not movable to a position where said slider is out of contact with said pivotable arm.

25. A nozzle for dispensing fluid comprising:

a nozzle body including a spout and fluid path through which fluid to be dispensed is flowable;

an actuator configured to detect when said spout is sufficiently inserted into a fluid receptacle;

a shut-off device configured to selectively terminate or prevent fluid dispensing through said fluid path; and an interlock operatively coupling said actuator to said shut-off device, said interlock including a slider that is operatively coupled to said actuator and a pivotable arm that is operatively coupled to said shut-off device, and wherein said slider is slidable along said pivotable arm, wherein said actuator is configured to be in an extended position when said spout is not inserted into said fluid receptacle, wherein said actuator is configured to move to a retracted position when said spout is sufficiently inserted into said fluid receptacle, and wherein the actuator further includes a pair of pushrods configured to at least partially transmit said movement of said actuator to said interlock.

26. The nozzle of claim 25 wherein said pushrods are symmetrically positioned with respect to a longitudinal axis of said nozzle.

27. A nozzle for dispensing fluid comprising:

a nozzle body including a spout and fluid path through which fluid to be dispensed is flowable;

a shut-off device configured to selectively terminate or prevent fluid dispensing through said fluid path; and an interlock including an actuator configured to detect when said spout is sufficiently inserted into a fluid receptacle, said interlock being operatively coupled to said shut-off device, wherein said interlock includes a slider having an angled or curved engagement surface and wherein said actuator is operatively coupled to said slider, and wherein said interlock further includes a pivotable arm in operative slidable contact with said engagement surface.

28. The nozzle of claim 27 wherein said interlock and said shut-off device are configured to terminate or prevent fluid dispensing unless said nozzle is sufficiently inserted into said fluid receptacle.

29. The nozzle of claim 27 wherein the shut-off device includes a diaphragm defining a diaphragm plane, and wherein the slider has an engagement surface that has a variable distance to the diaphragm plane along a length of the engagement surface in a direction perpendicular to the diaphragm plane.

30. A nozzle for dispensing fluid comprising:

a nozzle body including a spout and fluid path through which fluid to be dispensed is flowable;

a shut-off device configured to selectively terminate or prevent fluid dispensing through said fluid path, said shut-off device including a diaphragm and being configured to terminate or prevent fluid dispensing when liquid is detected at at least part of said spout; and an interlock operatively coupled to said shut-off device and including an actuator configured to detect when said spout is sufficiently inserted into a fluid receptacle, said actuator being configured to be in an extended position when said spout is not inserted into said fluid receptacle, and wherein said actuator is configured to be in a retracted position when said spout is sufficiently inserted into said fluid receptacle, wherein said interlock includes a slider having an angled or curved engagement surface and said actuator is operatively coupled to said slider, and wherein said interlock further includes a pivotable arm configured to be in operative slidable contact with said engagement surface and operatively coupled to said diaphragm, and wherein said angled or curved engagement surface presents to said pivotable arm a portion having an effectively increased thickness in a direction perpendicular to said diaphragm when said actuator moves from said extended position to said retracted position to thereby move said diaphragm.

31. The nozzle of claim 30 wherein said diaphragm is generally flat and planar, said slider is slidable in a direction generally parallel to said plane, and said pivotable arm is pivotable about an axis oriented generally parallel to said plane.

* * * * *